US009704681B2

(12) United States Patent
Fukuyama et al.

(10) Patent No.: US 9,704,681 B2
(45) Date of Patent: Jul. 11, 2017

(54) CONDUCTION BREAKING DEVICE

(71) Applicant: TOYODA GOSEI CO., LTD., Kiyosu-shi, Aichi-ken (JP)

(72) Inventors: Takaki Fukuyama, Kiyosu (JP); Yoshiki Nakamura, Kiyosu (JP); Keisuke Hori, Kiyosu (JP)

(73) Assignee: TOYODA GOSEI CO., LTD., Aichi-pref. (JP)

( * ) Notice: Subject to any disclaimer, the term of this patent is extended or adjusted under 35 U.S.C. 154(b) by 0 days.

(21) Appl. No.: 15/156,617

(22) Filed: May 17, 2016

(65) Prior Publication Data

US 2016/0351364 A1 Dec. 1, 2016

(30) Foreign Application Priority Data

May 29, 2015 (JP) ..... 2015-109418

(51) Int. Cl.
*H01H 39/00* (2006.01)

(52) U.S. Cl.
CPC ..... *H01H 39/006* (2013.01); *H01H 2039/008* (2013.01)

(58) Field of Classification Search
CPC .... H01H 31/003; H01H 19/025; H01H 1/021; H01H 1/023; H01H 1/20; H01H 1/44; H01H 1/50; H01H 2003/268; H01H 21/54; H01H 2205/002; H01H 2223/002; H01H 33/122; H01H 33/128; H01H 33/24; H01H 33/6661; H01H 39/006; H01H 9/16; H01H 33/03
See application file for complete search history.

(56) References Cited

U.S. PATENT DOCUMENTS 4,224,487 A * 9/1980 Simonsen ..... H01H 39/006 200/61.08
7,123,124 B2 * 10/2006 Caruso ..... H01H 39/006 200/61.08
7,239,225 B2 * 7/2007 Tirmizi ..... H01H 39/006 337/157
7,511,600 B2 * 3/2009 Von Behr ..... H01H 39/006 200/61.08

(Continued)

FOREIGN PATENT DOCUMENTS

JP 2012-138286 A 7/2012
JP 2014-049300 A 3/2014

*Primary Examiner* — Truc Nguyen
(74) *Attorney, Agent, or Firm* — Posz Law Group, PLC

(57) ABSTRACT

The conduction breaking device includes a conductive body, a fixed blade, an arc-extinguishing chamber, a gas generator, a cutting member, and a cutting delaying portion. The fixed blade and the arc-extinguishing chamber are located on one side of the cuttable portion with respect to a thickness direction of the cuttable portion in the conductive body. The gas generator is located on the opposite side of the cuttable portion with respect to the thickness direction. The cutting member is arranged between the cuttable portion and the gas generator and includes a movable blade. The cutting delaying portion is provided at the movable blade and configured to allow a part of an area of the cuttable portion that is, in the width direction, closer to the center than the edges are to the center to be cut after the other parts are cut.

7 Claims, 9 Drawing Sheets

(56) References Cited

U.S. PATENT DOCUMENTS

| | | | | |
|---|---|---|---|---|
| 8,432,246 | B2 * | 4/2013 | Suzuki | H01H 9/12 200/61.08 |
| 8,957,335 | B2 * | 2/2015 | Sprenger | B23D 15/145 200/61.04 |
| 9,153,402 | B2 * | 10/2015 | Ukon | H01H 39/006 |
| 9,230,713 | B2 * | 1/2016 | Adachi | B60K 28/14 |
| 9,236,208 | B2 * | 1/2016 | Ukon | H01H 39/006 |
| 9,246,152 | B2 * | 1/2016 | Lee | H01M 2/1077 |
| 9,324,522 | B2 * | 4/2016 | Nakamura | H01H 39/006 |
| 9,425,010 | B2 * | 8/2016 | Hentschel | H01H 39/006 |
| 2004/0041682 | A1 * | 3/2004 | Pasha | H01H 39/006 337/401 |
| 2013/0263714 | A1 | 10/2013 | Ukon et al. | |
| 2014/0061161 | A1 | 3/2014 | Nakamura et al. | |

* cited by examiner

Fig.14
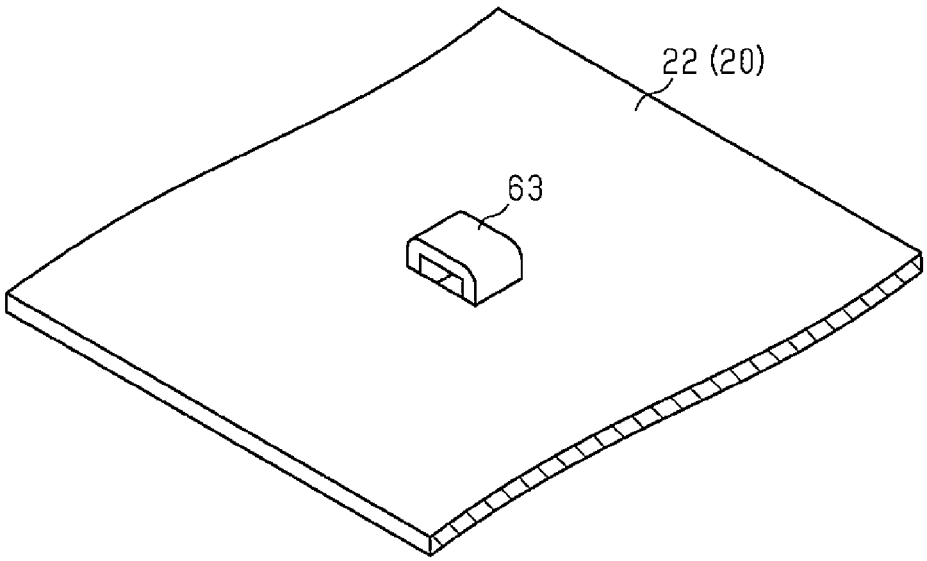
Fig.15A
Fig.15B
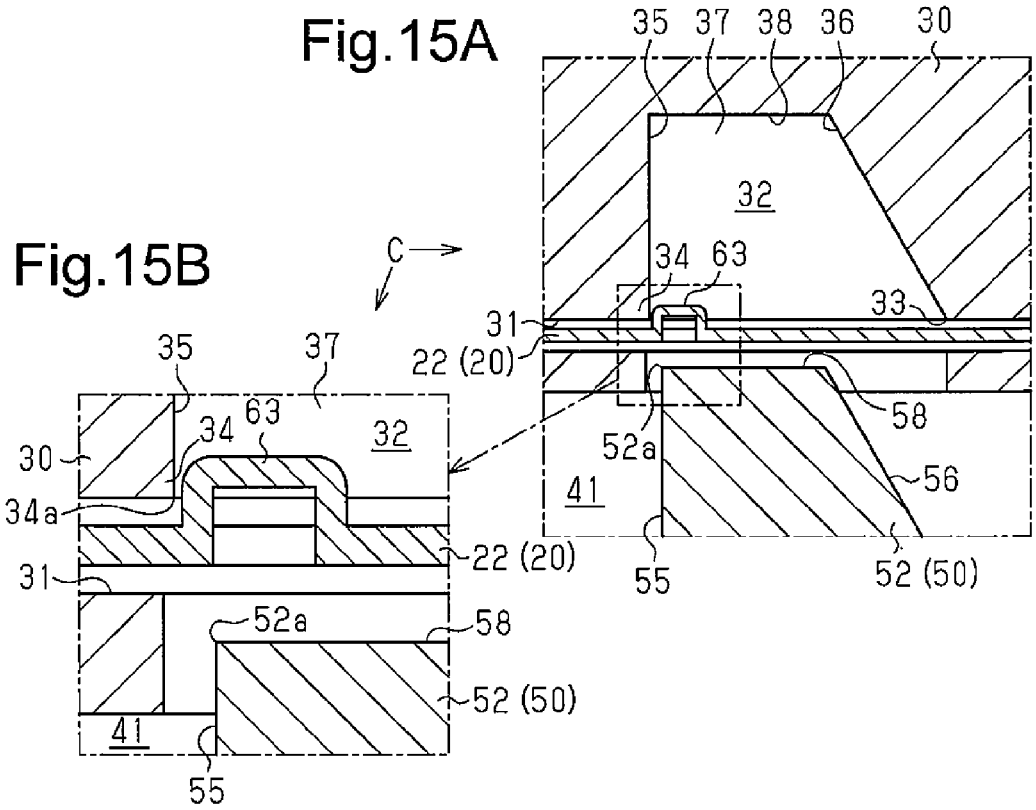

CONDUCTION BREAKING DEVICE

BACKGROUND OF THE INVENTION

The present invention relates to a conduction breaking device that breaks conduction between two devices constituting an electric circuit by cutting a conductive body extending between the devices.

Some electric circuits are provided with a conduction breaking device for breaking conduction between devices by being activated when a malfunction occurs in a device in the electric circuit or in a system on which the electric circuit is mounted. As one form of such conduction breaking devices, Japanese Laid-Open Patent Publication No. 2014-49300 discloses a conduction breaking device C shown in FIGS. 16A and 16B, which includes a conductive body 80, a gas generator (not shown), a fixed blade 84, and a cutting member 85.

The conductive body 80 includes an elongated plate-shaped cuttable portion 81 and is arranged between devices that constitute an electric circuit. The gas generator is arranged on one side of the cuttable portion 81 with respect to the thickness direction (on the lower side as viewed in FIG. 16A). The fixed blade 84 is arranged on the opposite side of the cuttable portion 81 from the gas generator with respect to the thickness direction. The cutting member 85 includes a movable blade 86 and is arranged between the cuttable portion 81 and the gas generator.

The cutting member 85 receives the pressure of the gas generated by the gas generator and is moved toward the cuttable portion 81. As the cutting member 85 is moved, the cuttable portion 81 receives shearing force generated by the fixed blade 84 and the movable blade 86. The shearing force cuts the cuttable portion 81 along the width. When the cuttable portion 81 is cut over the entire width, a pair of cut edges 82, 83 is formed in the cuttable portion 81. As shown in FIGS. 17A and 17B, the cut edges 82, 83 are separated from each other in the longitudinal direction and the thickness direction of the cuttable portion 81, so that the conduction between the devices is broken.

When the conductive body 80 in a current-carrying state is cut as described above, an arc may be generated due to the potential difference between a part of the cut edge 82 that is cut at the end (a cut end 82*e*) and a part of the cut edge 83 that is cut at the end (a cut end 83*e*). An arc refers to a phenomenon in which insulation of gas present between the cut ends 82*e*, 83*e* is broken and a current flows between the cut ends 82*e*, 83*e*.

When an arc is generated, the cut ends 82*e*, 83*e* are electrically connected to each other. In this case, although being physically cut, the conductive body 80 may remain in a current-carrying state, in which conduction is not broken. Additionally, the arc may melt the conductive body 80 and its surrounding plastic members.

In this regard, the conduction breaking device C disclosed in Japanese Laid-Open Patent Publication No. 2014-49300 has an arc-extinguishing chamber 87. Surrounding walls that define the arc-extinguishing chamber 87 are made of a material having the electrical insulating property. The arc-extinguishing chamber 87 is arranged on the opposite side of the cuttable portion 81 from the gas generator with respect to the thickness direction of the cuttable portion 81 (on the upper side as viewed in FIG. 16A) and is adjacent to the fixed blade 84.

Thus, a part of the broken cuttable portion 81 that has the cut edge 82 is located close to the fixed blade 84, and a part that has the cut edge 83 is pushed into the arc-extinguishing chamber 87 by the movable blade 86. The cut edge 83 is moved away from the cut edge 82, and the arc generated between the cut ends 82*e*, 83*e* is attenuated in the arc-extinguishing chamber 87.

An arc has the property of flowing along the shortest one (shortest path RS) of the electric short circuit paths connecting the cut ends 82*e*, 83*e*. When the cut ends 82*e*, 83*e* are located at the central portion in the width direction of the cuttable portion 81, a path that extends in the longitudinal direction and the thickness direction of the cuttable portion 81 in the arc-extinguishing chamber 87 forms the shortest path RS. Thus, an arc flows along the shortest path RS in the arc-extinguishing chamber 87 and is properly attenuated in the arc-extinguishing chamber 87.

However, depending on the dimensional accuracy and the assembly accuracy of the components of the conduction breaking device C, the positions of the cut ends 82*e*, 83*e* in the width direction of the cuttable portion 81 vary. If the cut ends 82*e*, 83*e* are located at one of the edges in the width direction of the cuttable portion 81 as shown in FIG. 16B, a path through the outside of the arc-extinguishing chamber 87 forms the shortest path RS. Therefore, an arc flows along the shortest path RS through the outside of the arc-extinguishing chamber 87 as shown in FIGS. 16A, 16B and FIGS. 17A, 17B. In this case, the arc may not be properly attenuated.

SUMMARY OF THE INVENTION

Accordingly, it is an objective of the present invention to provide a conduction breaking device that restrains an arc from flowing outside an arc-extinguishing chamber.

To achieve the foregoing objective and in accordance with one aspect of the present invention, a conduction breaking device configured to break conduction between a pair of devices in an electric circuit is provided. The conduction breaking device includes a conductive body, a fixed blade and an arc-extinguishing chamber, a gas generator, and a cutting member. The conductive body is arranged between the devices and includes an elongated plate-shaped cuttable portion. The fixed blade and an arc-extinguishing chamber are located on one side of the cuttable portion with respect to a thickness direction of the cuttable portion and are arranged to be adjacent to each other. The gas generator is located on the opposite side of the cuttable portion from the fixed blade and the arc-extinguishing chamber with respect to the thickness direction. The gas generator generates gas toward the arc-extinguishing chamber. The cutting member is arranged between the cuttable portion and the gas generator and receives a pressure of the gas toward the arc-extinguishing chamber. The cutting member includes a movable blade, which moves in a section that is close to the fixed blade in a longitudinal direction of the cuttable portion and cooperates with the fixed blade to cut the cuttable portion. When the cuttable portion is cut, a pair of cut edges separated from each other is formed in the cuttable portion so that conduction between the devices is broken. Each cut edge includes a cut end, which corresponds to a part of the cut edge that is cut at the end. An arc generated between the cut ends of the cut edges is attenuated in the arc-extinguishing chamber. The conduction breaking device further includes at least one cutting delaying portion, which is configured to allow a part of an area of the cuttable portion that is, in a width direction of the cuttable portion, closer to a center than edges are to the center to be cut after the other parts are cut.

With the above configuration, when the gas generator generates gas while the conductive body is carrying a current, the pressure of the gas directed toward the arc-extinguishing chamber acts on the cutting member. The movable blade of the cutting member moves a section that is close to the fixed blade in the longitudinal direction of the cuttable portion toward the arc-extinguishing chamber. As the movable blade moves, the cuttable portion receives a shearing force generated by the movable blade and the fixed blade. The shearing force cuts the cuttable portion over the entire width so that the cuttable portion is divided at the cut edges. A part of the divided cuttable portion that has one of the cut edges is located close to the fixed blade, and a part that has the other cut edge is pushed into the arc-extinguishing chamber by the movable blade. Since the cut edges are separated away from each other in the longitudinal direction and the thickness direction of the cuttable portion, the conduction between the devices is broken.

A potential difference may occur between a cut end, or a part of one cut edge that is cut at the end, and another cut end, or a part of the other cut edge that is cut at the end. Such a potential difference may generate an arc. The arc has the property of flowing along the shortest one (shortest path) of the electric short circuit paths connecting the cut ends.

In this regard, the cutting delaying portion allows a part of the area of the cuttable portion that is, in the width direction, closer to the center than the edges are to the center to be cut after the other parts are cut. When that part of the area is cut at the end, the cuttable portion is cut over the entire width. In a pair of the cut edges, which have been formed by cutting the cuttable portion, the cut ends are formed by parts of the area that are, in the width direction, closer to the center than the opposite ends are to the center. Among a plurality of electric short circuit paths connecting the cut ends, a path that extends in the longitudinal direction and the thickness direction of the cuttable portion in the arc-extinguishing chamber tends to be the shortest path. An arc flows along the shortest path in the arc-extinguishing chamber and is thus properly attenuated in the arc-extinguishing chamber.

BRIEF DESCRIPTION OF THE DRAWINGS

FIG. 14 is a partial perspective view of a conduction breaking device for a vehicle according to a third embodiment, showing a cutting delaying portion and its surrounding in the cuttable portion.

FIG. 15A is a partial cross-sectional view corresponding to FIG. 3, showing the conduction breaking device according to the third embodiment in a state before the cuttable portion is cut.

FIG. 15B is an enlarged partial cross-sectional view showing a part of FIG. 15A.

DETAILED DESCRIPTION OF THE PREFERRED EMBODIMENTS

First Embodiment

A conduction breaking device C for a vehicle according to a first embodiment will now be described with reference to FIGS. 1 to 10.

Figure 2:
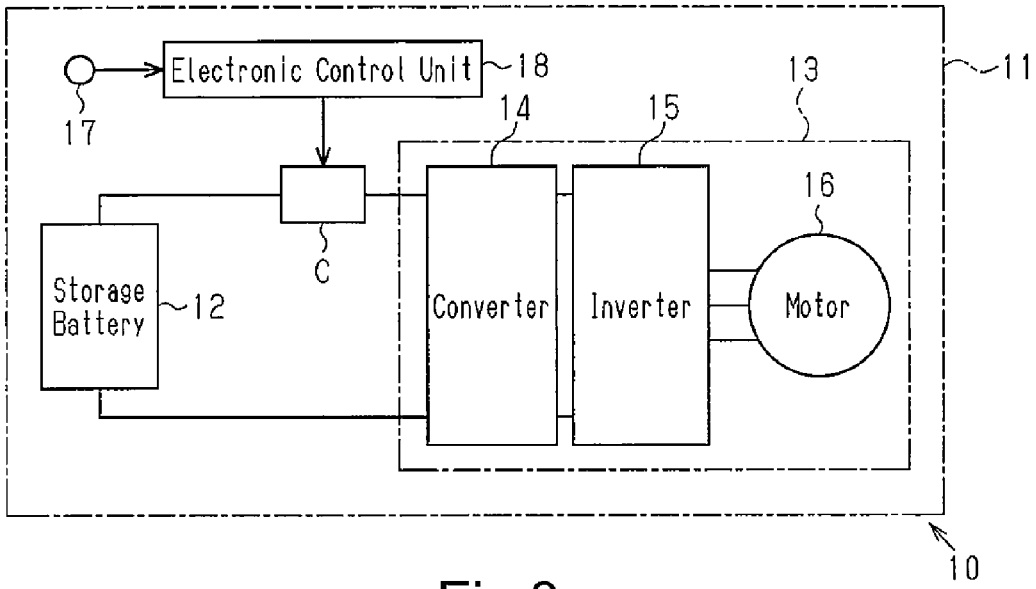
FIG. 2 is a schematic diagram showing an electric circuit in which the conduction breaking device of FIG. 1 is used.

FIG. 2 shows an electric circuit 11 in which the conduction breaking device C is incorporated. The electric circuit 11 includes as its components a storage battery 12 and an electric device 13. In the electric circuit 11, the electric device 13 is operated by power supplied from the storage battery 12. The electric device 13 is configured by a converter 14, which increases the voltage of the power delivered from the storage battery 12 and outputs power of the increased voltage, an inverter 15, which converts DC power from the converter 14 into AC power suitable for driving a motor and outputs the AC power, and a motor 16, which is driven by the AC power output from the inverter 15.

The electric circuit 11 is mounted on a vehicle 10. When the vehicle 10 receives an impact due to a collision, the electric device 13 may not properly operate, or current leakage from the electric circuit 11 may occur. Thus, the vehicle 10 is provided with the conduction breaking device C, which breaks, at a collision, conduction between devices in the electric circuit 11, such as between the storage battery 12 and the electric device 13. The vehicle 10 includes a collision sensor 17 for detecting presence of a collision and outputting the detected result as an output signal and an electronic control unit 18, which is configured mainly of a microcomputer and receives the output signal of the collision sensor 17. When detecting a collision of the vehicle 10 based on an output signal of the collision sensor 17, the electronic control unit 18 activates the conduction breaking device C. The activation of the conduction breaking device C discontinues the supply of power from the storage battery 12 to the electric device 13.

Figure 1:
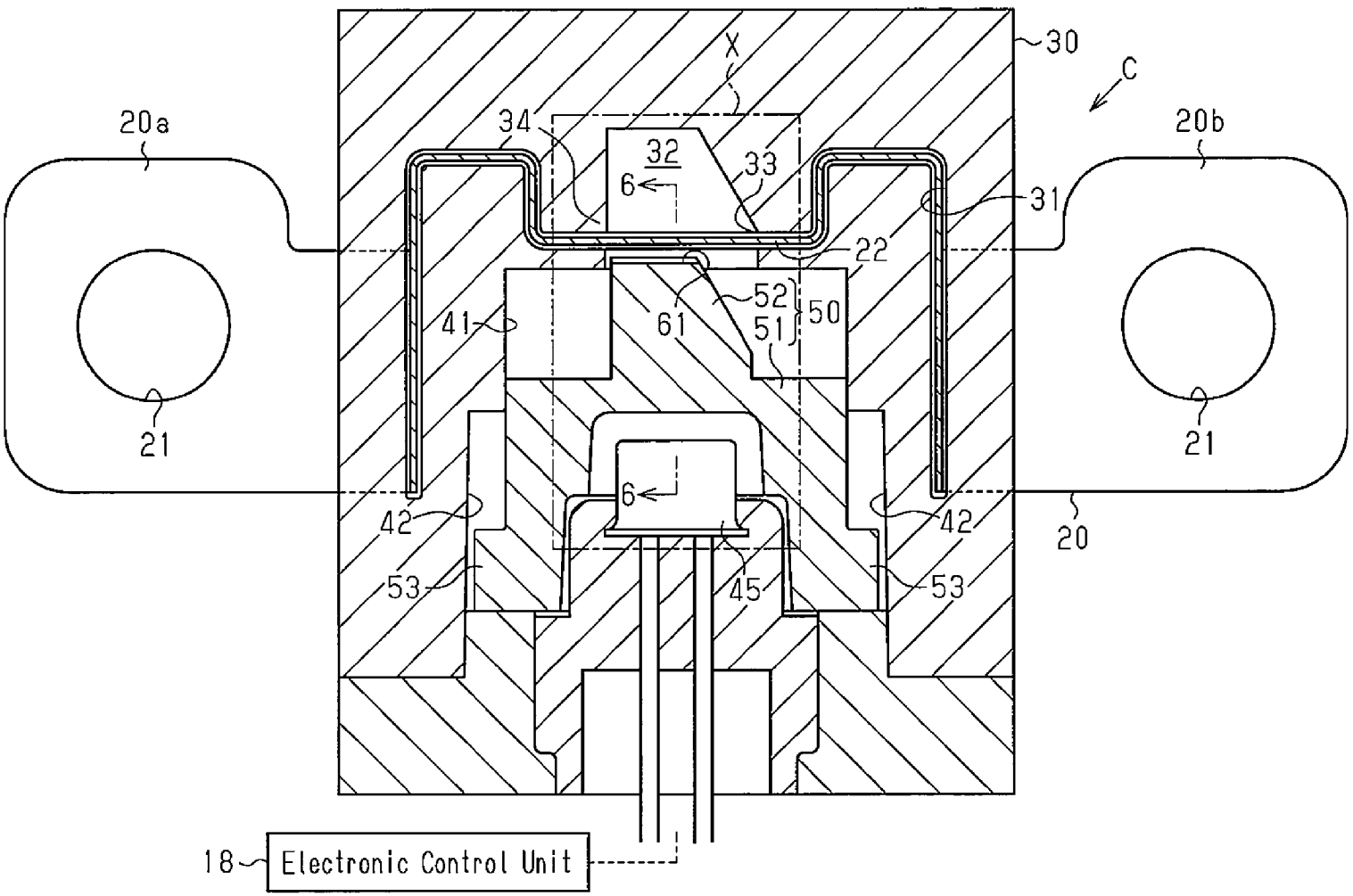
FIG. 1 is a cross-sectional view showing the internal structure of a conduction breaking device for a vehicle according to a first embodiment.

As illustrated in FIG. 1, the conduction breaking device C includes a conductive body 20, a case 30, an explosive type gas generator 45, and a cutting member 50. Components in the conduction breaking device C will be described below.

<Conductive Body 20>

The conductive body 20 forms a conduction path for establishing conduction between the storage battery 12 and the converter 14 and is also referred to as a bus bar. The conductive body 20 is made of a metal material having a high electric conductivity. A typical example of such a metal material is copper, but other materials such as brass or aluminum may be used. The opposite ends of the conductive body 20 configure external connectors 20*a*, 20*b*. The external connectors 20*a* and 20*b* are connected to the storage battery 12 and the converter 14. Specifically, each of the external connectors 20*a*, 20*b* has a through hole 21. A fastener such as a screw is inserted in each through hole 21 so that one of the external connectors 20*a* and 20*b* is connected to a terminal conductive with the storage battery 12 and the other is connected to a terminal conductive with the converter 14. In this way, the conductive body 20 is connected to the terminals of the storage battery 12 and the converter 14 in the electric circuit 11, respectively, via the external connectors 20*a* and 20*b*, so that the storage battery 12 and the converter 14 are electrically connected to each other via the conductive body 20.

The conductive body 20 has an elongated plate-shaped cuttable portion 22 arranged between the external connectors 20*a*, 20*b*. The cuttable portion 22 extends between the external connectors 20*a* and 20*b* in their arrangement direction (in the lateral direction as viewed in FIG. 1).

The direction in which the cuttable portion 22 extends, or the direction in which the external connectors 20*a* and 20*b* are arranged, is denoted as a longitudinal direction of the cuttable portion 22. The thickness direction of the cuttable portion 22 (the vertical direction as viewed in FIG. 1) refers to the thickness direction of the cuttable portion 22 before being cut. The direction perpendicular to the longitudinal direction and the thickness direction of the cuttable portion 22 (the direction perpendicular to the elevation of FIG. 1) corresponds to the width direction of the cuttable portion 22.

The cross-sectional area of the cuttable portion 22 in a plane perpendicular to the longitudinal direction of the cuttable portion 22 is set to be the same at a section to be cut by a cutting member 50 (section-to-be-cut), which will be discussed below, and sections about the section-to-be-cut.

<Case 30>

The case 30 is made of a material having an electrical insulating property and a high strength such as a plastic. As shown in FIG. 1, the case 30 includes an arrangement portion 31, in which the conductive body 20 is arranged. The conductive body 20 is arranged in the arrangement portion 31 with the external connectors 20*a* and 20*b* exposed to the outside of the case 30. The case 30 includes an arc-extinguishing chamber 32 located on one side of the cuttable portion 22 with respect to the thickness direction (on the upper side as viewed in FIG. 1).

Figure 5:
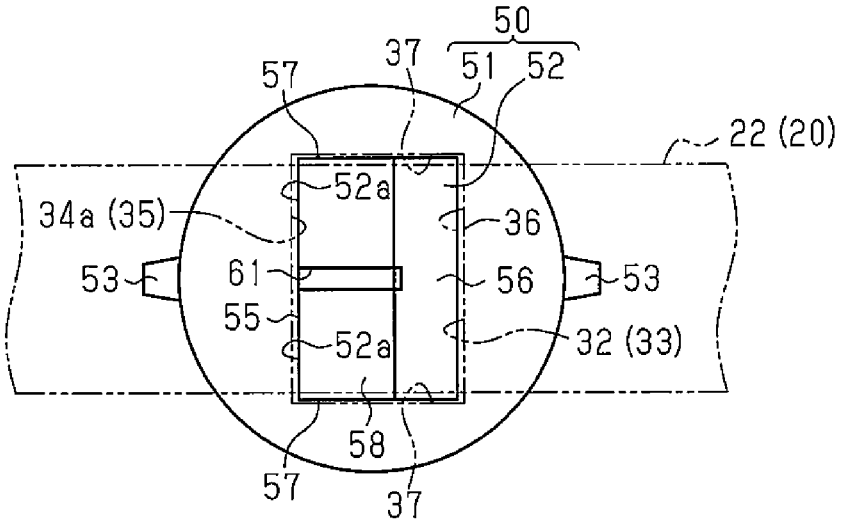
FIG. 5 is a partial plan view showing the positional relationship among the cuttable portion before being cut, the cutting member, and the arc-extinguishing chamber in the conduction breaking device according to the first embodiment.

In the arc-extinguishing chamber 32, the cutting member 50 cuts the cuttable portion 22. When the cuttable portion 22 is cut, a pair of cut ends 23*e*, 24*e* is formed (see FIG. 9) and an arc is generated between the cut ends 23*e*, 24*e*. The generated arc is attenuated in the arc-extinguishing chamber 32. As shown in FIG. 5, the depth of the arc-extinguishing chamber 32 is set to be slightly greater than the width of the cuttable portion 22 so that the cuttable portion 22 can enter, when cut, the arc-extinguishing chamber 32.

Figure 3:
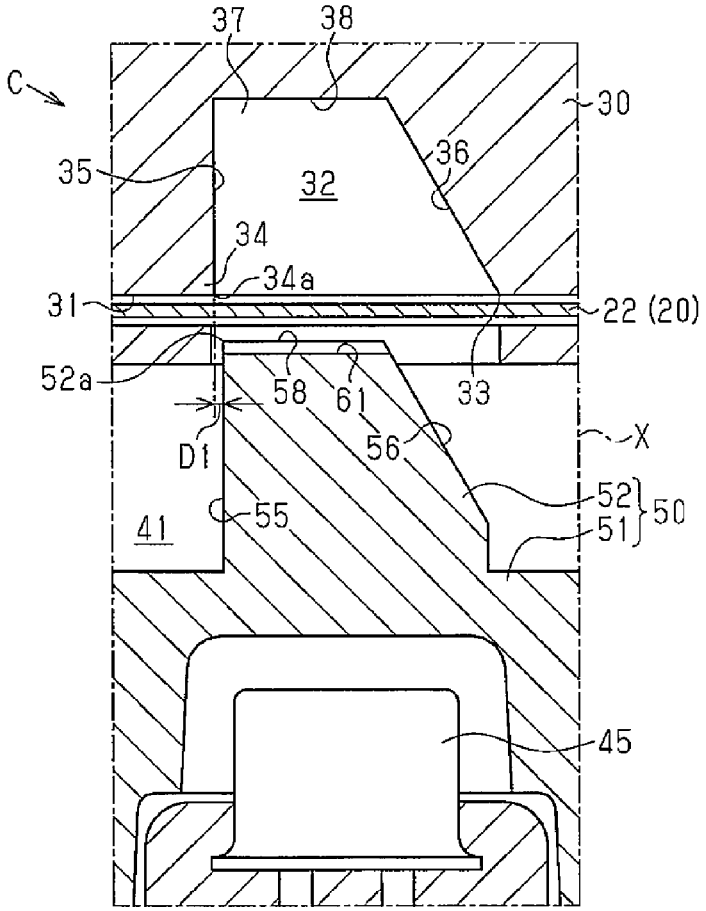
FIG. 3 is an enlarged partial cross-sectional view showing section X in FIG. 1.

As shown in FIGS. 3 and 5, the arc-extinguishing chamber 32 has a rectangular opening 33, which faces the cuttable portion 22 before being cut. The four sides defining the opening 33 include a first side, which extends in the width direction of the cuttable portion 22.

The arc-extinguishing chamber 32 has a first side wall surface 35, a second side wall surface 36, a pair of third side wall surfaces 37, and a bottom wall surface 38. The first side wall surface 35 includes the first side of the opening 33 and extends in a direction perpendicular to or substantially perpendicular to the cuttable portion 22. The first side in the first side wall surface 35 and the parts in the vicinity constitute a fixed blade 34 adjacent to the opening 33. Particularly, the first side of the opening 33 constitutes a cutting edge 34*a* of the fixed blade 34.

The second side wall surface 36 is located at a position away from the first side wall surface 35 in the longitudinal direction of the cuttable portion 22. As shown in FIG. 3, the second side wall surface 36 is inclined with respect to the first side wall surface 35 such that the space between the second side wall surface 36 and the first side wall surface 35 decreases as the distance from the opening 33 increases. The third side wall surfaces 37 face each other in the width direction of the cuttable portion 22. The bottom wall surface 38 is away from the opening 33 and is parallel with or substantially parallel with the cuttable portion 22 before being cut.

As shown in FIG. 1, the case 30 has a guide chamber 41, which is located on the opposite side of the cuttable portion 22 from the arc-extinguishing chamber 32 with respect to the thickness direction of the cuttable portion 22 (on the lower side as viewed in FIG. 1). The guide chamber 41 extends in the thickness direction of the cuttable portion 22 and has a substantially cylindrical shape. Guide grooves 42, which extend in the thickness direction of the cuttable portion 22, are formed in the inner wall of the guide chamber 41.

<Gas Generator 45>

The gas generator 45 is used as a drive source of the conduction breaking device C. The gas generator 45 is arranged in the case 30 with a part exposed to the guide chamber 41. That is, the gas generator 45 is located on the opposite side of the cuttable portion 22 from the arc-extinguishing chamber 32 with respect to the thickness direction of the cuttable portion 22. The gas generator 45 is connected to the electronic control unit 18. The gas generator 45 receives an activation signal from the electronic control unit 18 to ignite and burn the incorporated explosive in response to the input activation signal, thereby generating gas.

In general, a device driven by the explosive type gas generator 45 can be more quickly driven, and is of lower costs and more reliable in its operation than a device using another system (such as electromagnetic one) as a drive source.

<Cutting Member 50>

The cutting member 50 is located in the guide chamber 41 and arranged between the cuttable portion 22 and the gas generator 45. The cutting member 50 includes a substantially columnar main body 51, which extends in the thickness direction of the cuttable portion 22, and a movable blade 52, which protrudes toward the arc-extinguishing chamber 32 from the main body 51. The movable blade 52 cooperates with the fixed blade 34 to cut the cuttable portion 22 along the width. Guide protrusions 53, which extend in the thickness direction of the cuttable portion 22, are formed on the outer wall of the main body 51. The guide protrusions 53 of the main body 51 are engaged with the guide grooves 42 of the guide chamber 41 so that the main body 51 is engaged with the guide chamber 41 to be movable toward the arc-extinguishing chamber 32.

Figure 4:
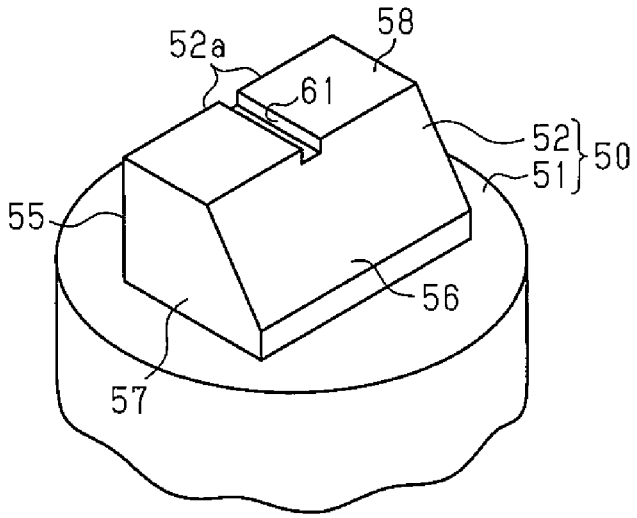
FIG. 4 is a partial perspective view showing a part of the cutting member of the conduction breaking device according to the first embodiment.

As shown in FIGS. 3 to 5, the movable blade 52 has a first side wall surface 55, a second side wall surface 56, a pair of third side wall surfaces 57, and a distal end surface 58. The first side wall surface 55 is located at a position away from the cutting edge 34*a* of the fixed blade 34 by a small distance D1 in the longitudinal direction of the cuttable portion 22 and extends in a direction perpendicular to or substantially perpendicular to the cuttable portion 22 before being cut. The distance D1 is preferably set to a value suitable for the movable blade 52 to cooperate with the fixed blade 34 to cut (shear) the cuttable portion 22. For example, the distance D1 is set to approximately 0.5 mm.

The second side wall surface 56 of the movable blade 52 is located at a position away from the first side wall surface 55 in the longitudinal direction of the cuttable portion 22. The second side wall surface 56 is inclined in accordance with the second side wall surface 36 of the arc-extinguishing chamber 32. That is, as shown in FIG. 3, the second side wall surface 56 is inclined with respect to the first side wall surface 55 such that the distance between the second side wall surface 56 and the first side wall surface 55 decreases as the distance from the main body 51 increases. The third side wall surfaces 57 face each other in the width direction of the cuttable portion 22. The distal end surface 58 is located on the movable blade 52 at a position away from the main body 51. The most part of the distal end surface 58 is parallel with or substantially parallel with the cuttable portion 22 before being cut.

The boundary between the first side wall surface 55 and the distal end surface 58 extends in the width direction of the cuttable portion 22 and constitutes a cutting edge 52*a* of the movable blade 52.

The cutting member 50 is made of a material having an electrical insulating property and a high strength such as a plastic.

Figure 9:
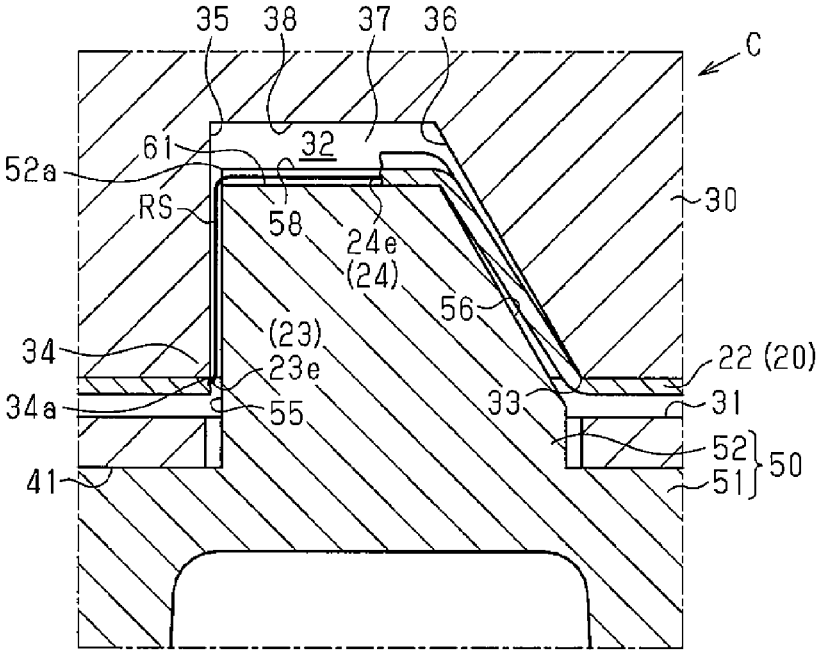
FIG. 9 is a partial cross-sectional view showing the cutting member after moving further from the state shown in FIG. 8 and cutting the cuttable portion.
Figure 10:
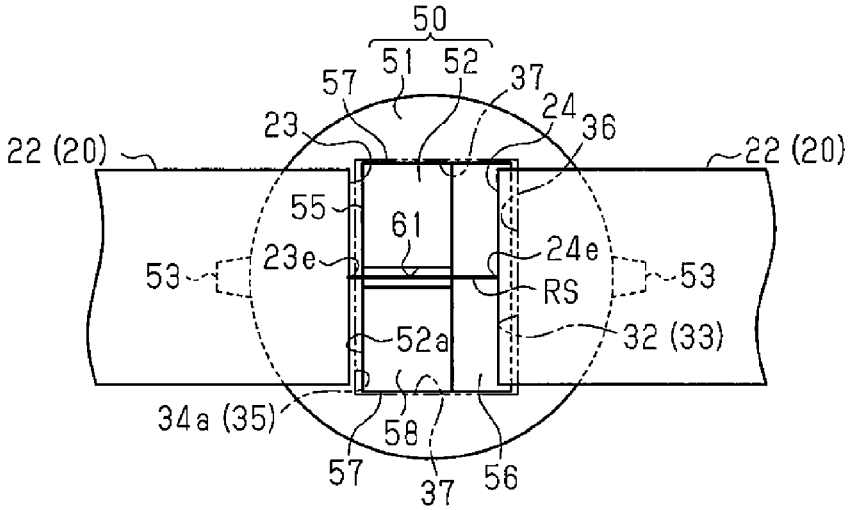
FIG. 10 is a partial plan view showing the positional relationship among the cut cuttable portion, the cutting member, and the arc-extinguishing chamber in the first embodiment.

When the cuttable portion 22 is cut by the cutting member 50 along the width as shown in FIGS. 9 and 10, a pair of cut edges 23, 24 is formed in the cuttable portion 22. The cut edges 23, 24 are separated from each other in the longitudinal direction and the thickness direction of the cuttable portion 22.

The above described structure is the basic structure of the conduction breaking device C. As shown in FIGS. 4 and 5, the conduction breaking device C of the first embodiment has a first cutting delaying portion 61 in addition to the basic structure. The cutting delaying portion 61 is configured to cut a part of an area of the cuttable portion 22 that is, in the width direction of the cuttable portion 22, closer to the center than the edges are to the center after the other parts of the cuttable portion 22 are cut. In the first embodiment, the first cutting delaying portion 61 is located in the cutting edge 52*a* of the movable blade 52 at the central portion in the width direction of the cuttable portion 22. The first cutting delaying portion 61 is constituted by a recess that is recessed toward the proximal end of the movable blade 52, that is, toward the main body 51. In the first embodiment, the recess is shaped to have a constant or substantially constant width in the depth direction. The first cutting delaying portion 61 is formed not only in the cutting edge 52*a* but also over the entire length of the distal end surface 58 in the longitudinal direction of the cuttable portion 22.

The cutting edge 34*a* of the fixed blade 34 does not have such a cutting delaying portion (recess), but has a straight structure along the width of the cuttable portion 22.

In the cuttable portion 22, a section to be cut by the fixed blade 34 and the movable blade 52 has the same shape as the other sections of the cuttable portion 22.

Operation of the conduction breaking device C according to the first embodiment, which is configured as described above, will now be described.

Figure 6:
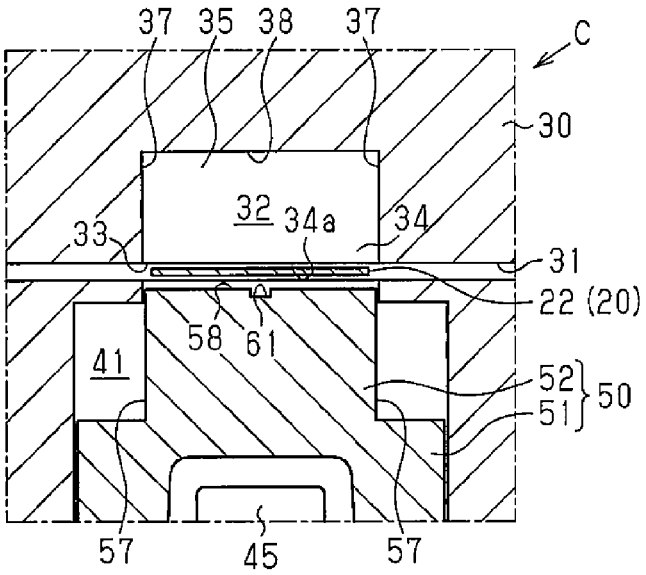
FIG. 6 is a cross-sectional view taken along line 6-6 of FIG. 1.

When no collision of the vehicle 10 is detected by the collision sensor 17, no activation signal is output from the electronic control unit 18 to the gas generator 45, and gas is not generated from the gas generator 45. As shown in FIGS. 1, 3, and 6, the cutting member 50 is located between the cuttable portion 22 and the gas generator 45 and is away from the arc-extinguishing chamber 32. Therefore, the storage battery 12 and the converter 14 are electrically connected to each other via the conductive body 20.

The cross-sectional area of the cuttable portion 22 along a plane perpendicular to the longitudinal direction is the same at the section-to-be-cut, which is designed to be cut by the fixed blade 34 and the movable blade 52, and at sections about the section-to-be-cut. Therefore, when the conductive body 20 is carrying a current, the section-to-be-cut and the surrounding sections carry the same amount of current.

When a collision of the vehicle 10 is detected by the collision sensor 17 while the conductive body 20 is carrying a current, the electronic control unit 18 delivers an activation signal to the gas generator 45. The activation signal activates the gas generator 45 to generate gas. The cutting member 50 receives the pressure of the gas directed toward the arc-extinguishing chamber 32. The guide protrusions 53 are guided in the guide grooves 42 of the guide chamber 41, so that the cutting member 50 is guided toward the arc-extinguishing chamber 32.

The cutting member 50, which receives the pressure of the gas as described above, is rapidly moved toward the arc-extinguishing chamber 32. As the cutting member 50 is moved, the movable blade 52 moves a section that is close to the fixed blade 34 in the longitudinal direction of the cuttable portion 22 toward the arc-extinguishing chamber 32. The movable blade 52 contacts the cuttable portion 22 and pushes the cuttable portion 22 toward the arc-extinguishing chamber 32. The cuttable portion 22 receives a shearing force generated by the cutting edge 52*a* of the movable blade 52 and the cutting edge 34*a* of the fixed blade 34. The shearing force cuts the cuttable portion 22 along the width. When the cuttable portion 22 is cut along the entire width as shown in FIGS. 9 and 10, a pair of cut edges 23, 24 is formed in the cuttable portion 22. That is, the cuttable portion 22 is divided at the two cut edges 23, 24.

After the cut edge 23 is formed, the part of the divided cuttable portion 22 that includes the cut edge 23 is not pushed by the movable blade 52 and is located close to the cutting edge 34*a* of the fixed blade 34.

In contrast, the cutting member 50 continues to move after the cutting is done, so that the movable blade 52 enters the arc-extinguishing chamber 32 through the opening 33. The part of the divided cuttable portion 22 that includes the cut edge 24 is pushed into the arc-extinguishing chamber 32 by the movable blade 52. The part of the divided cuttable portion 22 that includes the cut edge 24 is pushed by the movable blade 52 and is bent at an obtuse angle along the inclined second side wall surface 56 of the movable blade 52 and the inclined second side wall surface 36 of the arc-extinguishing chamber 32. The load required to bend the cuttable portion 22 is smaller than the load required to cut the cuttable portion 22. Therefore, the load required to move the cutting member 50 toward the arc-extinguishing chamber 32 is reduced.

The cut edge 24 is located between the bottom wall surface 38 of the arc-extinguishing chamber 32 and the distal end surface 58 of the movable blade 52, which has entered the arc-extinguishing chamber 32. Since the cut edges 23, 24 are separated away from each other in the longitudinal direction and the thickness direction of the cuttable portion 22, the conduction between the devices is broken.

A potential difference may occur between the cut end 23*e*, which corresponds to a section of the cut edge 23 that is cut at the end and the cut end 24*e*, which corresponds to a section of the cut edge 24 that is cut at the end. Such a potential difference may generate an arc. The arc has the property of flowing along the shortest one (shortest path RS) of the electric short circuit paths connecting the cut ends 23*e*, 24*e*.

If the cut ends 23*e*, 24*e* were formed at one of the edges in the width direction of the cuttable portion 22, a path through the outside of the arc-extinguishing chamber 32 would be the shortest path RS. Thus, the arc would flow along the shortest path RS outside the arc-extinguishing chamber 32.

Figure 7B:
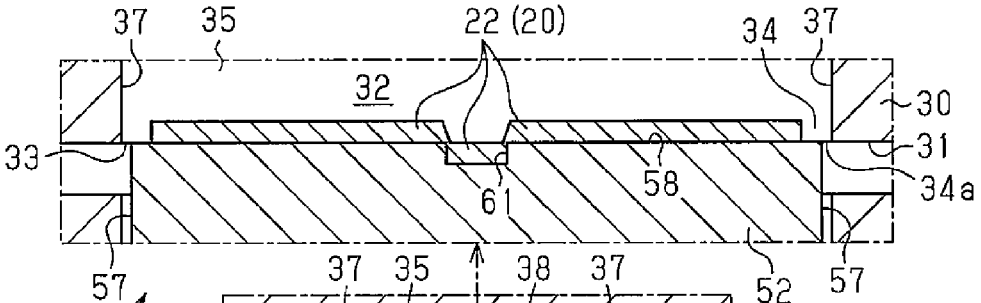
FIG. 7B is an enlarged partial cross-sectional view showing a part of FIG. 7A.
Figure 7A:
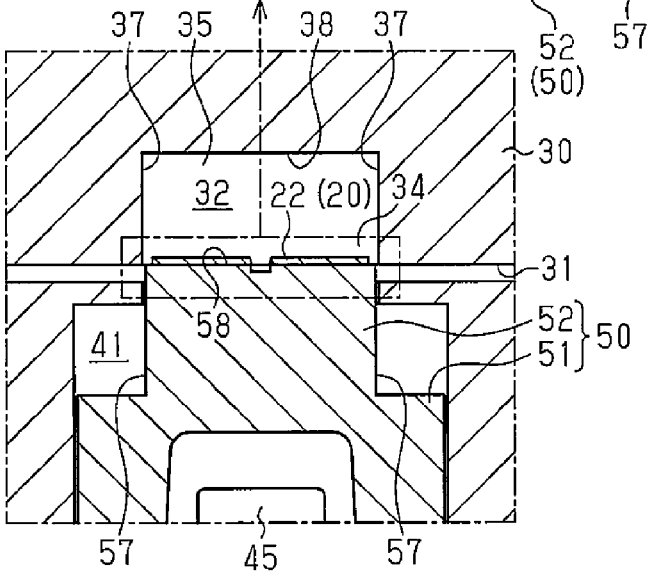
FIG. 7A is a partial cross-sectional view showing the cutting member while moving toward the arc-extinguishing chamber from the state shown in FIG. 6 and in a process of cutting the cuttable portion.
Figure 8:
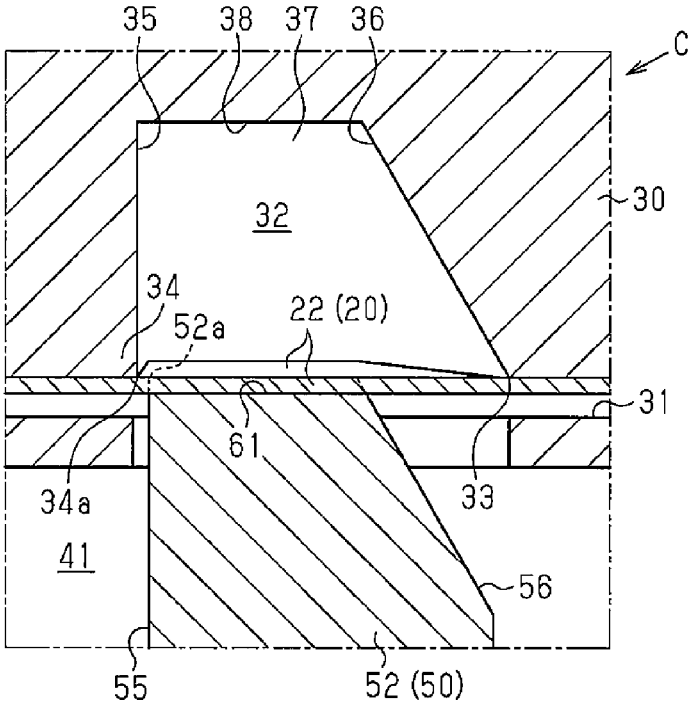
FIG. 8 is a partial cross-sectional view showing the cutting member while moving toward the arc-extinguishing chamber from the state shown in FIG. 3 and in a process of cutting the cuttable portion.

However, as shown in FIGS. 7A, 7B, and 8, the conduction breaking device C of the first embodiment has the first cutting delaying portion 61, which is a recess that is recessed toward the proximal end of the movable blade 52 and located in the cutting edge 52*a* of the movable blade 52 at the central portion in the width direction of the cuttable portion 22. In the conduction breaking device C, the inner wall edge of the recess (the first cutting delaying portion 61) cooperates with the cutting edge 34*a* of the fixed blade 34 to deliver the function of cutting the cuttable portion 22. The function of the inner wall edge of the recess is delivered at a time later than the time at which the sections of the cuttable portion 22 other than the central portion in the width direction of the cuttable portion 22 are cut by the section of the cutting edge 52*a* at which the first cutting delaying portion 61 (recess) is not provided. FIGS. 7A and 7B illustrate a state in which the cuttable portion 22 has been cut except for the central portion in the width direction.

Thus, the central portion in the width direction of the cuttable portion 22 is cut after the other parts are cut. As shown in FIGS. 9 and 10, the cuttable portion 22 is cut over the entire width when the central portion in the width direction is cut at the end. In this case, the parts at the central portion in the width direction of the cut edges 23, 24, which are formed by cutting the cuttable portion 22, form the cut ends 23*e*, 24*e*. In the following description, the cut ends 23*e*, 24*e*, which are constituted by the central portions of the cut edges 23, 24 in the width direction, will be referred to as central cut ends 23*e*, 24*e* in the conduction breaking device C.

The central portion in the width direction of the cuttable portion 22 is cut at the end as described above. Thus, among a plurality of electric short circuit paths connecting the central cut ends 23*e*, 24*e* to each other, the paths extending in the longitudinal direction and the thickness direction of the cuttable portion 22 in the arc-extinguishing chamber 32 are shorter than those through the outside of the arc-extinguishing chamber 32. Among a plurality of electric short circuit paths connecting the central cut ends 23*e*, 24*e*, a path that extends in the longitudinal direction and the thickness direction of the cuttable portion 22 in the arc-extinguishing chamber 32 forms the shortest path RS. An arc flows along the shortest path RS in the arc-extinguishing chamber 32 and is properly attenuated in the arc-extinguishing chamber 32.

As a result, negative influences of arcs on the conduction breaking device C are reduced. The central cut ends 23*e*, 24*e* are thus unlikely to be electrically connected by an arc. It is thus unlikely that conduction will remain unbroken and the conductive body 20 will remain in a current-carrying state, although the conductive body 20 is physically cut. The conductive body 20 and the surrounding components made of plastic (for example, the case 30) are restrained from being softened or melted due to exposure to arcs of high temperatures.

The first embodiment as described above has the following advantages.

(1) The conduction breaking device C is configured to break conduction between devices by moving the cutting member 50 toward the arc-extinguishing chamber 32 with the gas generated by the gas generator 45 to cut the cuttable portion 22 of the conductive body 20 along the width with the fixed blade 34 and the movable blade 52. The conduction breaking device C has the first cutting delaying portion 61 (FIGS. 7A, 7B).

Thus, the central portion in the width direction of the cuttable portion 22 is cut after the other parts are cut. This restricts an arc from flowing outside the arc-extinguishing chamber 32, so that the arc is adequately attenuated in the arc-extinguishing chamber 32.

(2) The cross-sectional area of the cuttable portion 22 along a plane perpendicular to the longitudinal direction of the cuttable portion 22 is set to be the same at the section-to-be-cut and at sections about the section-to-be-cut (FIGS. 5 and 6).

Therefore, when the conductive body 20 is carrying a current, the section-to-be-cut and the sections about the section-to-be-cut carry the same amount of current.

(3) A recess that is recessed toward the proximal end of the movable blade 52 is provided in the cutting edge 52*a* at the central portion in the width direction of the cuttable portion 22. The recess constitutes the first cutting delaying portion 61 (FIGS. 4 and 5).

The first cutting delaying portion 61, that is, the inner wall edge of the recess, cooperates with the cutting edge 34*a* of the fixed blade 34 to cut the cuttable portion 22, so that the central portion in the width direction of the cuttable portion 22 is cut after the other parts are cut. That is, the central portion in the width direction of the cuttable portion 22 is cut at the end to achieve advantage (1).

Second Embodiment

Next, a conduction breaking device C for a vehicle according to a second embodiment will now be described with reference to FIGS. 11A to 13B.

Figure 11B:
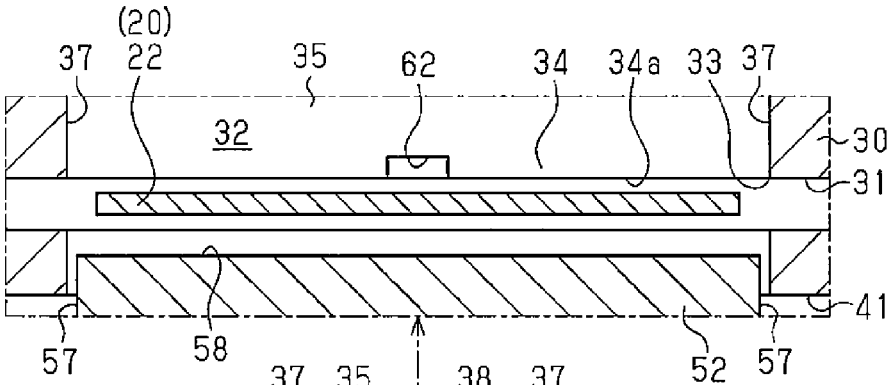
FIG. 11B is an enlarged partial cross-sectional view showing a part of FIG. 11A.
Figure 11A:
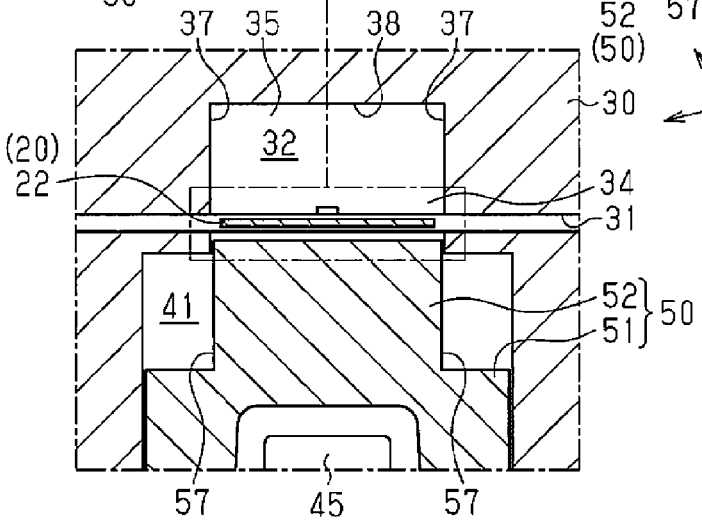
FIG. 11A is a partial cross-sectional view corresponding to FIG. 6, showing a conduction breaking device for a vehicle according to a second embodiment.
Figure 12:
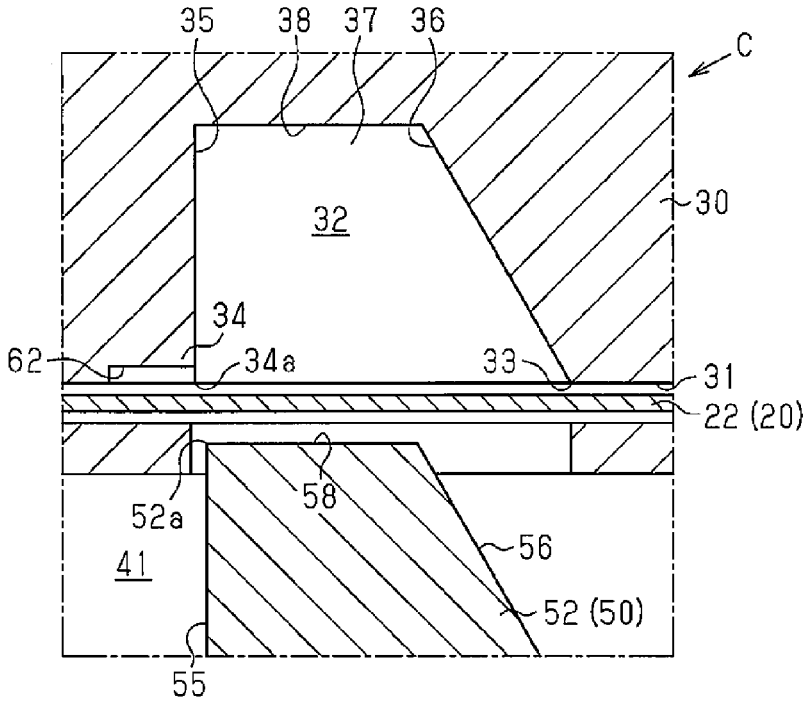
FIG. 12 is a partial cross-sectional view corresponding to FIG. 3, showing the conduction breaking device according to the second embodiment in a state before the cuttable portion is cut.

As shown in FIGS. 11A, 11B, and 12, a cutting delaying portion is not provided in the movable blade 52, but provided in the fixed blade 34 in the second embodiment. That is, in the second embodiment, the cutting delaying portion is provided in a different portion from that in the first embodiment.

Specifically, a second cutting delaying portion 62 in the second embodiment is provided in the cutting edge 34*a* of the fixed blade 34 at the central portion in the width direction of the cuttable portion 22. The second cutting delaying portion 62 is constituted by a recess that is recessed toward the leading side (the upper side as viewed in FIGS. 11A, 11B, and 12) in the moving direction of the movable blade 52.

The cutting edge 52*a* of the movable blade 52 does not have such a recess, but has a straight structure along the width of the cuttable portion 22.

In the cuttable portion 22, a section to be cut by the fixed blade 34 and the movable blade 52 (the section-to-be-cut) has the same shape as the other sections of the cuttable portion 22.

Other than these differences, the second embodiment is the same as the first embodiment. Thus, like or the same reference numerals are given to those components that are like or the same as the corresponding components described above in the first embodiment and detailed explanations are omitted.

Figure 13B:
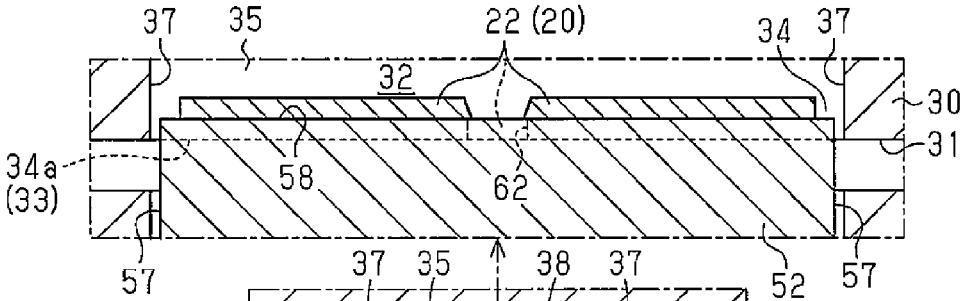
FIG. 13B is an enlarged partial cross-sectional view showing a part of FIG. 13A.
Figure 13A:
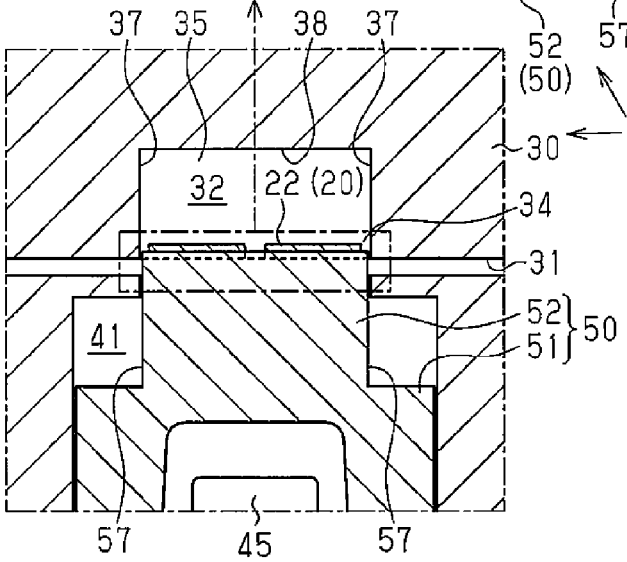
FIG. 13A is a partial cross-sectional view corresponding to FIG. 7A, showing the conduction breaking device according to the second embodiment.
Figure 16A:
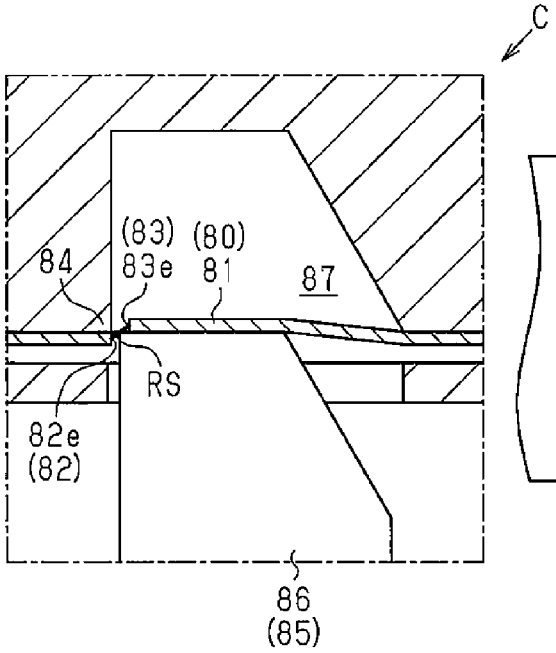
Fig.16A(Prior Art)
FIG. 16A is a partial cross-sectional view of a conventional conduction breaking device, showing a state immediately after the cuttable portion is cut.
Figure 16B:
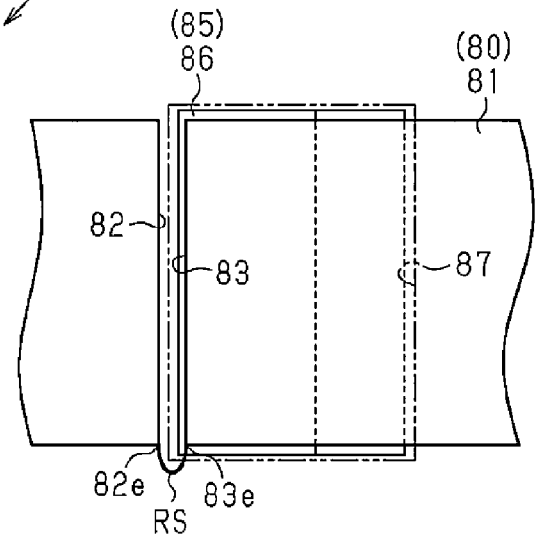
Fig.16B(Prior Art)
FIG. 16B is a partial plan view showing the positional relationship among the cut cuttable portion, the movable blade of the cutting member, and the arc-extinguishing chamber in the conventional conduction breaking device of FIG. 16A.
Figure 17A:
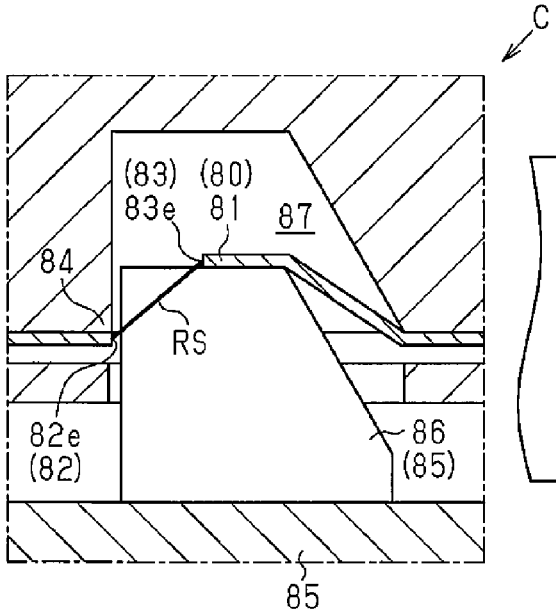
Fig.17A(Prior Art)
FIG. 17A is a partial cross-sectional view of the conventional conduction breaking device of FIG. 16A, showing a state in which the movable blade of the cutting member is entering the arc-extinguishing chamber.
Figure 17B:
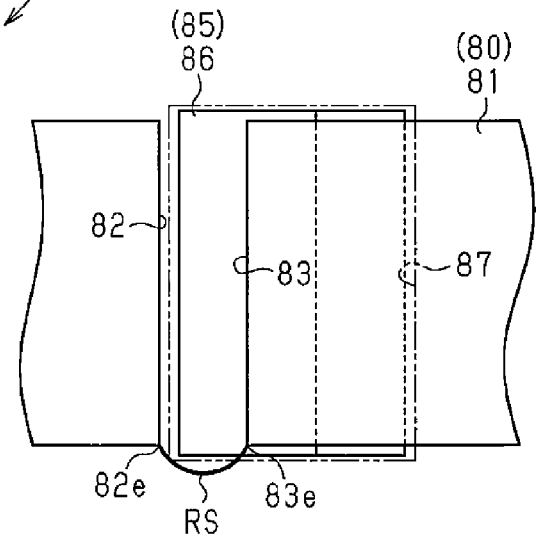
Fig.17B(Prior Art)
FIG. 17B is a partial plan view showing the positional relationship among the cut cuttable portion, the movable blade of the cutting member, and the arc-extinguishing chamber in the conventional conduction breaking device of FIG. 16A.

As described above, the conduction breaking device C of the second embodiment has a recess in the cutting edge 34*a* of the fixed blade 34 at the central portion in the width direction of the cuttable portion 22. The recess is recessed toward the leading side in the moving direction of the movable blade 52 and constitutes the second cutting delaying portion 62. In the conduction breaking device C of the second embodiment, as shown in FIGS. 13A and 13B, the second cutting delaying portion 62 of the fixed blade 34, that is, the inner wall edge of the recess, delivers the function of cutting the cuttable portion 22 with the cutting edge 52*a* of the movable blade 52. This function is delivered at a time later than the time at which the sections of the cuttable portion 22 other than the central portion in the width direction of the cuttable portion 22 are cut by the section of the cutting edge 34*a* of the fixed blade 34 at which the second cutting delaying portion 62 is not provided. FIGS. 13A and 13B illustrate a state in which the cuttable portion 22 has been cut except for the central portion in the width direction.

Thus, as in the first embodiment, the central portion in the width direction of the cuttable portion 22 is cut after the other parts are cut in the second embodiment. When the central portion in the width direction of the cuttable portion 22 is cut at the end, the cuttable portion 22 is cut over the entire width. Thus, although not illustrated, the central portions in the width direction of the cut edges 23, 24, which are formed by cutting the cuttable portion 22, form the cut ends 23*e*, 24*e*, or the central cut ends 23*e*, 24*e*.

As a result, as in the first embodiment, among a plurality of electric short circuit paths connecting the central cut ends 23*e*, 24*e*, a path that extends in the longitudinal direction and the thickness direction of the cuttable portion 22 in the arc-extinguishing chamber 32 forms the shortest path RS. An arc flows along the shortest path RS in the arc-extinguishing chamber 32 and is properly attenuated in the arc-extinguishing chamber 32.

Thus, the second embodiment has the same advantages as the above described advantages (1) and (2). Since the cutting delaying portion is provided at a position different from that in the first embodiment, the following advantage is achieved in place of advantage (3).

(4) A recess that is recessed toward the leading side in the moving direction of the movable blade 52 is provided in the cutting edge 34*a* at the central portion in the width direction of the cuttable portion 22. The recess constitutes the second cutting delaying portion 62 (FIGS. 11B and 12).

Thus, the second cutting delaying portion 62 cuts the central portion in the width direction of the cuttable portion 22 after the other parts are cut. That is, the central portion in the width direction of the cuttable portion 22 is cut at the end to achieve advantage (1).

Third Embodiment

Next, a conduction breaking device C for a vehicle according to a third embodiment will now be described with reference to FIGS. 14, 15A, and 15B.

As shown in FIGS. 15A and 15B, a cutting delaying portion is not provided in the movable blade 52 or the fixed blade 34, but is provided in the cuttable portion 22 in the third embodiment. That is, in the third embodiment, the cutting delaying portion is provided in a different portion from those in the first and second embodiments.

As shown in FIGS. 14 and 15B, the central portion of the section-to-be-cut of the cuttable portion 22 in the width direction is located closer to the leading side in the moving direction of the movable blade 52 (the upper side as viewed in FIGS. 14, 15A, and 15B) than the other sections. The central part constitutes a third cutting delaying portion 63 of the third embodiment.

The third cutting delaying portion 63 is formed, for example, in the following manner. First, two slits, which extend in the longitudinal direction of the cuttable portion 22 and are spaced from each other, are formed at the central portion in the width direction of the section-to-be-cut of the cuttable portion 22. Subsequently, the part of the cuttable portion 22 between the slits is deformed to protrude toward the leading side in the moving direction of the movable blade 52.

Thus, in the cuttable portion 22 in which the third cutting delaying portion 63 is provided, the cross-sectional area of the cuttable portion 22 along a plane perpendicular to the longitudinal direction of the cuttable portion 22 is the same at the section-to-be-cut and at the sections about the section-to-be-cut, as in the first end second embodiments.

Neither the cutting edge 52*a* of the movable blade 52 nor the cutting edge 34*a* of the fixed blade 34 has such a cutting delaying portion (recess), but the cutting edges 52*a*, 34*a* have a straight structure along the width of the cuttable portion 22.

Other than these differences, the third embodiment is the same as the first and second embodiments. Thus, like or the same reference numerals are given to those components that are like or the same as the corresponding components described above in the first and second embodiments and detailed explanations are omitted.

In the conduction breaking device C of the third embodiment, the central portion of the section-to-be-cut of the cuttable portion 22 in the width direction is located closer to the leading side in the moving direction of the movable blade 52 than the other sections and constitutes the third cutting delaying portion 63. Thus, if parts other than the central portion in the width direction of the cuttable portion 22 are being cut, the shearing force generated by the fixed blade 34 and the movable blade 52 does not act on the third cutting delaying portion 63, and the third cutting delaying portion 63 is not cut. The third cutting delaying portion 63 is cut after the parts different from the central portion in the width direction of the cuttable portion 22 are cut. When the third cutting delaying portion 63 is cut at the end, the cuttable portion 22 is cut over the entire width. Thus, although not illustrated, the central portions in the width direction of the cut edges 23, 24, which are formed by cutting the cuttable portion 22, form the cut ends 23*e*, 24*e*, or the central cut ends 23*e*, 24*e*.

As a result, as in the first and second embodiments, among a plurality of electric short circuit paths connecting the central cut ends 23*e*, 24*e*, a path that extends in the longitudinal direction and the thickness direction of the cuttable portion 22 in the arc-extinguishing chamber 32 forms the shortest path RS. An arc flows along the shortest path RS in the arc-extinguishing chamber 32 and is properly attenuated in the arc-extinguishing chamber 32.

Thus, the third embodiment has the same advantages as the above described advantages (1) and (2). Since the cutting delaying portion is provided at a position different from those in the first and second embodiments, the following advantage is achieved in place of advantages (3) and (4).

(5) The central portion of the section-to-be-cut of the cuttable portion 22 in the width direction is located closer to the leading side in the moving direction of the movable blade 52 than the other parts and constitutes the third cutting delaying portion 63 (FIG. 14).

Thus, the third cutting delaying portion 63 cuts the central portion in the width direction of the cuttable portion 22 after the other parts are cut. That is, the central portion in the width direction of the cuttable portion 22 is cut at the end to achieve advantage (1).

The above embodiments may be modified as follows.

<Regarding Cutting Delaying Portion>

In the first embodiment, the first cutting delaying portion 61 may be located in the cutting edge 52*a* of the movable blade 52 at a position that is, in the width direction of the cuttable portion 22, closer to the center of the cuttable portion 22 than the edges of the cuttable portion 22 are to the center but different from the central portion in the width direction of the cuttable portion 22.

In the second embodiment, the second cutting delaying portion 62 may be located in the cutting edge 34*a* of the fixed blade 34 at a position that is, in the width direction of the cuttable portion 22, closer to the center of the cuttable portion 22 than the edges of the cuttable portion 22 are to the center but different from the central portion in the width direction of the cuttable portion 22.

In the third embodiment, the third cutting delaying portion 63 may be located in the section-to-be-cut of the cuttable portion 22 at a position that is, in the width direction of the cuttable portion 22, closer to the center of the cuttable portion 22 than the edges of the cuttable portion 22 are to the center but different from the central portion in the width direction of the cuttable portion 22.

Compared to a case in which the cuttable portion 22 is cut at one end in the width direction, the above modifications restrain an arc from flowing outside the arc-extinguishing chamber 32, though not to the extent of the case in which a cutting delaying portion is located at the central portion.

In the first embodiment, as long as the first cutting delaying portion 61 includes the cutting edge 52*a*, the first cutting delaying portion 61 may extend over the entire length of or over a part of the entire length of the distal end surface 58 in the longitudinal direction of the cuttable portion 22.

In the first and second embodiments, the widths of the recesses forming the first and second cutting delaying portions 61, 62 may decrease toward the bottoms. The recesses may have curved bottoms.

Two or three of the first to third embodiments may be combined. For example, when the first and second embodiments are combined, a recess is provided in the cutting edge 52*a* of the movable blade 52 at a position that is, in the width direction of the cuttable portion 22, closer to the center of the cuttable portion 22 than the edges of the cuttable portion 22 are to the center. Another recess is provided in the cutting edge 34*a* of the fixed blade 34 at a position that is, in the width direction of the cuttable portion 22, closer to the center of the cuttable portion 22 than the edges of the cuttable portion 22 are to the center. The recesses constitute the first and second cutting delaying portions, respectively.

In the third embodiment, the third cutting delaying portion 63 may have a curved surface shaped as a part of a sphere.

Other Modifications

In each of the above illustrated embodiments, the case 30 and the cutting member 50 are made of plastic. However, the case 30 and the cutting member 50 may be made of any material as long as it has a sufficient strength for cutting the cuttable portion 22 along the width and an adequate electrical insulating property.

In each of the above illustrated embodiments, as methods for forming the case 30 and the cutting member 50, any method may be employed such as molding and machining.

The conduction breaking device C is not limited to the one placed between the storage battery 12 and the converter 14. The present invention may be applied to any device that is placed between devices in an electric circuit and is designed to break the conduction between the devices. Such conduction breaking devices include, for example, a conduction breaking device placed between a fuel cell and a vehicle driving motor in a fuel cell vehicle, a conduction breaking device placed between a power source and an electric device in a stationary system, and a conduction breaking device placed between electric devices in a stationary system.

The invention claimed is:

1. A conduction breaking device configured to break conduction between a pair of devices in an electric circuit, the conduction breaking device comprising:

a conductive body arranged between the devices, wherein the conductive body includes an elongated plate-shaped cuttable portion;

a fixed blade and an arc-extinguishing chamber, which are located on one side of the cuttable portion with respect to a thickness direction of the cuttable portion and are arranged to be adjacent to each other;

a gas generator, which is located on the opposite side of the cuttable portion from the fixed blade and the arc-extinguishing chamber with respect to the thickness direction, wherein the gas generator generates gas toward the arc-extinguishing chamber; and a cutting member, which is arranged between the cuttable portion and the gas generator and receives a pressure of the gas toward the arc-extinguishing chamber, wherein the cutting member includes a movable blade, which moves in a section that is close to the fixed blade in a longitudinal direction of the cuttable portion and cooperates with the fixed blade to cut the cuttable portion, wherein when the cuttable portion is cut, a pair of cut edges separated from each other is formed in the cuttable portion so that conduction between the devices is broken, each cut edge includes a cut end, which corresponds to a part of the cut edge that is cut at the end, an arc generated between the cut ends of the cut edges is attenuated in the arc-extinguishing chamber, the cuttable portion includes two side edges extending in the longitudinal direction, and the conduction breaking device further comprises at least one cutting delaying portion configured to cut a part of the cuttable portion between the two side edges of the cuttable portion after cutting the side edges of the cuttable portion.

2. The conduction breaking device according to claim 1, wherein the cuttable portion includes a section-to-be-cut, which is cut by the fixed blade and the movable blade, and a cross-sectional area of the cuttable portion along a plane perpendicular to the longitudinal direction of the cuttable portion is set to be the same at the section-to-be-cut and at sections about the section-to-be-cut.

3. The conduction breaking device according to claim 1, wherein the movable blade further includes:

a distal end and a proximal end in a moving direction of the movable blade;

a cutting edge, which is provided at the distal end and extends along a width direction of the cuttable portion; and a recess, which is provided in the cutting edge at a position that corresponds to the part of the area of the cuttable portion between the side edges of the cuttable portion, wherein the recess is recessed toward the proximal end, and the at least one cutting delaying portion includes a first cutting delaying portion, which is constituted by the recess of the movable blade.

4. The conduction breaking device according to claim 1, wherein the fixed blade further includes:

a cutting edge, which extends along a width direction of the cuttable portion; and a recess, which is provided in the cutting edge of the fixed blade at a position that corresponds to the part of the area of the cuttable portion between the side edges of the cuttable portion, wherein the recess is recessed toward a leading side in a moving direction of the movable blade, and the at least one cutting delaying portion includes a second cutting delaying portion, which is constituted by the recess of the fixed blade.

5. The conduction breaking device according to claim 1, wherein the cuttable portion includes:

a section-to-be-cut, which is cut by the fixed blade and the movable blade; and a projected part, which is provided in the section-to-be-cut at a position that corresponds to the part of the area of the cuttable portion between the side edges of the cuttable portion, wherein the projected part is located closer to a leading side in a moving direction of the movable blade than the side edges of the cuttable portion, and the at least one cutting delaying portion includes a third cutting delaying portion, which is constituted by the projected part of the cuttable portion.

6. The conduction breaking device according to claim 3, wherein the fixed blade further includes:

a cutting edge, which extends along the width direction of the cuttable portion; and a recess, which is provided in the cutting edge of the fixed blade at a position that corresponds to the part of the area of the cuttable portion between the side edges of the cuttable portion, wherein the recess is recessed toward a leading side in the moving direction of the movable blade, and the at least one cutting delaying portion includes a second cutting delaying portion, which is constituted by the recess of the fixed blade.

7. The conduction breaking device according to claim 6, wherein the cuttable portion includes:

a section-to-be-cut, which is cut by the fixed blade and the movable blade, and a projected part, which is provided in the section-to-be-cut at a position that corresponds to the part of the area of the cuttable portion between the side edges of the cuttable portion, wherein the projected part is located closer to the leading side in the moving direction of the movable blade than the side edges of the cuttable portion, and the at least one cutting delaying portion includes a third cutting delaying portion, which is constituted by the projected part of the cuttable portion.

* * * * *